United States Patent [19]

Cavazza

[11] 4,447,957

[45] May 15, 1984

[54] ROLL DIAMETER SENSING DEVICE

[75] Inventor: Roberto Cavazza, Pianoro, Italy

[73] Assignee: SASIB S.p.A., Bologna, Italy

[21] Appl. No.: 402,340

[22] Filed: Jul. 27, 1982

[30] Foreign Application Priority Data

Jul. 28, 1981 [IT] Italy ..... 12596 A/81

[51] Int. Cl.[3] ..... G01B 5/10

[52] U.S. Cl. ..... 33/172 F; 33/136; 33/178 D

[58] Field of Search ..... 33/172 B, 136, 172 F, 33/178 D, 148 H, 149 J; 200/61.15, 61.16

[56] References Cited

U.S. PATENT DOCUMENTS

| | | | |
|---|---|---|---|
| Re. 30,868 | 2/1982 | Mori | 242/58.1 |
| 1,542,808 | 6/1925 | Adams | 200/61.16 |
| 3,110,110 | 11/1963 | Forrester et al. | 33/149 J |
| 3,201,057 | 8/1965 | Ryan | 242/58.1 |
| 3,285,525 | 11/1966 | Buckler | 242/55.12 |
| 3,519,213 | 7/1970 | Hofmann et al. | 200/61.16 |
| 3,802,085 | 4/1974 | Schoonmaker | 33/172 F |
| 4,215,482 | 8/1980 | Szewczyk | 33/178 D |

*Primary Examiner*—Willis Little

*Attorney, Agent, or Firm*—Spencer & Frank

[57] ABSTRACT

The device for sensing the outer diameter of a roll of web upon unwinding of the web from the roll for the actuation of a control member when the diameter of the roll has been reduced to a predetermined minimum diameter, comprises a follower arm capable of swinging movement to-and-fro in the direction of the axis of the roll around a fixed axis and urged in the direction of the said roll axis. The swinging movement of the follower arm controls the actuation of a control member. The follower arm carries a feeler element intended to bear against the circumferential surface of the web roll, and the said feeler element is constructed as a gauging fork or snap gauge having a pair of arms which are spaced between each other of a predetermined distance, in such a manner that the clear distance or clearance between the said two arms corresponds to the predetermined minimum diameter of the roll.

6 Claims, 3 Drawing Figures

ROLL DIAMETER SENSING DEVICE

BACKGROUND AND SUMMARY OF THE INVENTION

The present invention relates to a device for sensing the outer diameter of a roll of web material, such as paper, unrolled from the said roll for the feeding of any suitable operating machine, such as for example a cigarette making machine. More particularly, the diameter sensing device is adapted for the actuation of a control member operating a splicing device which, upon exhaustion of a roll, inserts in the cycle of the operating machine another new roll.

Of course, the control member must be actuated with the highest degree of accuracy, keeping in mind the high operational speeds of the operating machines: in fact, if the control member is actuated with delay, there might arise difficulties in the splicing operation, due to the fact that splicing machines usually require a certain reserve length of web from the roll being exhausted, for effecting a correct splicing operation, with no stresses or ruptures in the web; on the other hand, if the control member is actuated too early, then on the exhausted roll there remains a remarkable quantity of web which could have been used and which instead is discarded.

Roll diameter sensing devices are known in which there is employed a follower arm, capable of swinging towards the axis of the roll, and which is kept tangent to the outer circumference of the roll being unwound: the reduction of diameter of the roll causes the angular displacement of the follower arm which directly or indirectly acts on a microswitch whenever the predetermined minimum diameter has been reached. Other roll diameter sensing devices employ a photoelectric cell and a light emitting source operatively coupled with the said photoelectric cell, the paper roll being interposed between these two elements, so that the light beam will be intercepted by the full roll, while whenever the roll has reached a predetermined minimum diameter, the light beam will act on the cell, thus controlling the splicing operation.

Generally, the above mentioned known roll diameter sensing means are imprecise, since they are sensible to any possible eccentricity of the reel of the roll with respect to the axis of the roll-carrying mandrel. Due to the said eccentricity, the control signal from the control member for the splicing operation can be imparted too early (roll not completely exhausted), or too late (roll already exhausted, with no sufficient reserve length).

According to the present invention, a device for sensing the outer diameter of a roll of web upon unwinding of the said web from the said roll for the actuation of a control member when the diameter of the roll has been reduced to a predetermined minimum diameter, comprises a follower arms capable of swinging movement to-and-fro in the direction of the axis of the roll around a fixed axis and urged in the direction of the said roll axis. The swinging movement of the said follower arm controls the actuation of a control member, and said follower arm carries a feeler element intended to bear against the circumferential surface of the web roll. According to the present invention, the said feeler element is constructed as a gauging fork or snap gauge having a pair of arms which are spaced between each other of a predetermined distance, in such a manner that the clear distance or clearance between the said two arms corresponds to the predetermined minimum diameter of the roll, and that when the two arms swing over the roll after its diameter has, due to unwinding of the web, reached the predetermined minimum diameter, the follower arm acts on the control member.

In this manner, when the effective diameter of the roll has been reduced to the predetermined minimum, independently from any possible eccentricity of the reel of the roll with respect to the roll carrying mandrel, the gauging fork snaps over the residual roll, thus performing an ample swinging motion and safely actuating the control member for the operation of the splicing device or any other device.

BRIEF DESCRIPTION OF THE DRAWINGS

The above and other features of the invention and the advantages deriving therefrom, will appear evident from the following detailed description of a preferred embodiment made with reference to the annexed drawings, in which.

DESCRIPTION OF THE PREFERRED EMBODIMENT

Figure 1:
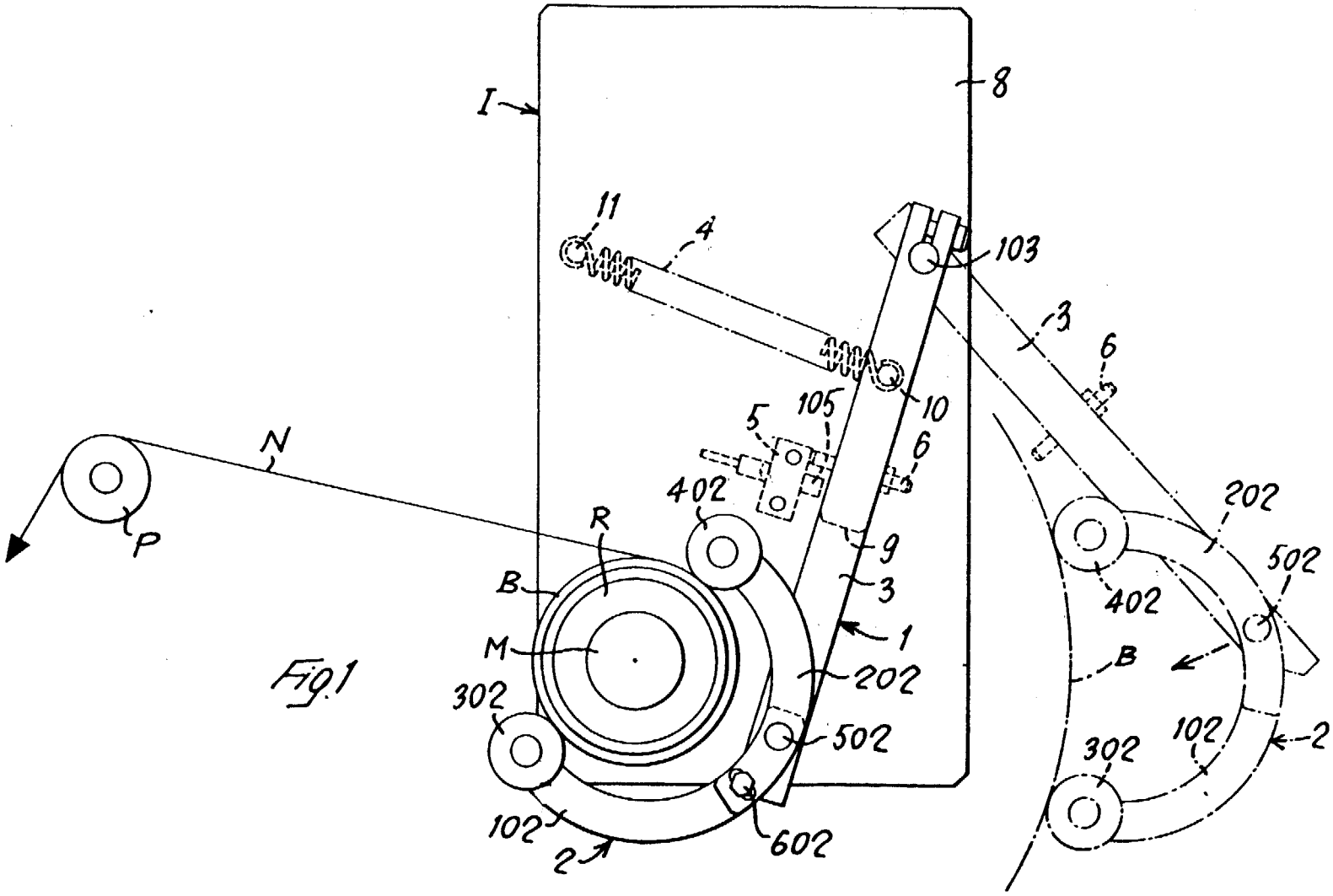
FIG. 1 is a diagrammatic front elevation view of a sensing device according to the invention in its final operational phase.

With reference to FIG. 1 of the drawings, the sensing device 1 serves for sensing the exhaustion of a roll B of web N, for example in a cigarette making machine.

In a machine of the mentioned type, the roll B of web N to be unwound for the feeding of a utilizer device, is fitted with its reel R onto an unwinding mandrel M carried by a fixed frame portion I of the machine.

In the sensing device 1 according to the invention, the feeler element which constantly senses the web N of the roll B during its progressive exhaustion, consists of a gauging fork 2 (substantially constructed as a snap gauge) presenting a pair of curved arms 102, 202 provided at their free ends with respective feeler rollers 302, 402.

The fork 2 is pivoted in a freely swingable manner, around the pin 502 provided at the free end of a swinging follower arm 3, which is pivoted by its other end to the machine frame I, on a shaft 103 which is parallel to the shaft of the mandrel M of the roll B. The follower arm 3 is constantly urged by a spring 4 to elastically engage by means of its rollers 302, 402, the web N of the roll B.

The clear distance, or clearance, between the arms 102, 202 and consequently the distance between the feeler rollers 302, 402, is adjusted by acting on the slot adjustment screw 602, so as to predetermine a minimum value of the diameter of the roll B, which is taken as standard of classification of the roll B as exhausted, for the control of subsequent operations, such as for example the operation of splicing of the web from the exhausted roll to the web of a reserve roll.

In the operation of the machine, the web N is unwound from roll B around a pulley P, and, as soon as the diameter of the roll B has reached the above mentioned minimum value, indicating that the roll B is to be considered as exhausted, the feeler rollers 302, 402 slide over and beyond the roll B itself, so that the fork 2 which up to that moment had been riding more and more deeply on the roll B, suddenly snaps over the roll, thus causing a quick and remarkable swinging movement of the follower arm 3, which by this swinging movement acts on a control member 5 which controls any desired automatic intervention in the operation of the machine.

The fork 2 can swing freely around its center and more precisely around the pin 502 mounted on the free end of the follower arm 3. In this manner, the sensing of the diameter of the roll B, effected by the feeler rollers 302, 402, is independent from any possible eccentricity of the mounting of the roll itself on the mandrel M, in consideration of the fact that this eccentricity (if present) will simply cause a relative motion of rotation between the fork and the follower arm, which motion neutralizes the error which would be otherwise induced by the said eccentricity as a consequence of the corresponding swinging movement of the follower arm 3.

The control member 5 can be of any suitable type, such as a microswitch, or a proximity switch, for example of the magnetically inductive type, in which the sensor 105 is protected by the adjustable abutment member 6 provided on the follower arm 3, and which abuts against a fixed stop member.

In the illustrated embodiment, the follower arm 3, at its end secured to the shaft 103, presents a clamp construction so as to clamp the said shaft 103, which is rotatably supported inside a flanged sleeve 7 mounted so as to project from a frame portion 8 of the frame I of the machine.

At the other end, the shaft 103 is connected by dowel with a lever 9 carrying an anchoring element 10 for the end of a return spring 4, which can be a suitably tensioned helical spring, the other end of which is anchored to an anchoring point 11 of the machine frame I. On the said lever 9 there is mounted the adjustable abutment member 6 for protecting the sensor 105 of the control member 5.

It is believed that the invention will have been clearly understood from the foregoing detailed description of a preferred embodiment. Changes in the details of construction may be resorted to without departing from the spirit of the invention, and it is accordingly intended that no limitation be implied and that the hereto annexed claims be given the broadest interpretation to which the employed language fairly admits.

I claim:

1. A device for sensing the outer diameter of a roll of web upon unwinding of the said web from the said roll for the actuation of a control member when the diameter of the roll has been reduced to a predetermined minimum diameter, comprising a follower arm capable of swinging movement to-and-fro in the direction of the axis of the roll around a fixed axis and urged in the direction of the said roll axis, a control member arranged in the path of the swinging movement of the said follower arm, said follower arm carrying a feeler element intended to bear against the circumferential surface of the web roll, said feeler element being constructed as a gauging fork or snap gauge having a pair of arms which are spaced a predetermined distance apart, in such a manner that the clearance between the said two arms corresponds to the predetermined minimum diameter of the roll and that when said two arms swing over the roll after its diameter has, due to unwinding of the web, reached said minimum diameter, said follower arm acts on said control member.

2. A sensing device according to claim 1, wherein the feeler element is mounted on the follower arm in a freely swingable manner around a pivot axis which is substantially parallel to the axis of the roll.

3. A sensing device according to claim 1, wherein the free ends of the arms of the feeler element are provided with freely rotatable feeler rollers.

4. A sensing device according to claim 1, wherein adjustment means are provided for the adjustment of the clearance between the two arms of the feeler element.

5. A sensing device according to claim 1, wherein the follower arm is urged in the direction of the axis of the roll under the action of spring means.

6. A sensing device according to claim 1, wherein the control member consists of a proximity switch mounted on a fixed frame structure, suitable adjustable abutment members being provided on the follower arm and on the said fixed frame, in order to protect the said proximity switch.

* * * * *

UNITED STATES PATENT AND TRADEMARK OFFICE

CERTIFICATE OF CORRECTION

PATENT NO. : 4,447,957

DATED : May 15, 1984

INVENTOR(S) : Robert Cavazza

It is certified that error appears in the above-identified patent and that said Letters Patent is hereby corrected as shown below:

The title page should be deleted to appear as per attached title page.

Figure 2:
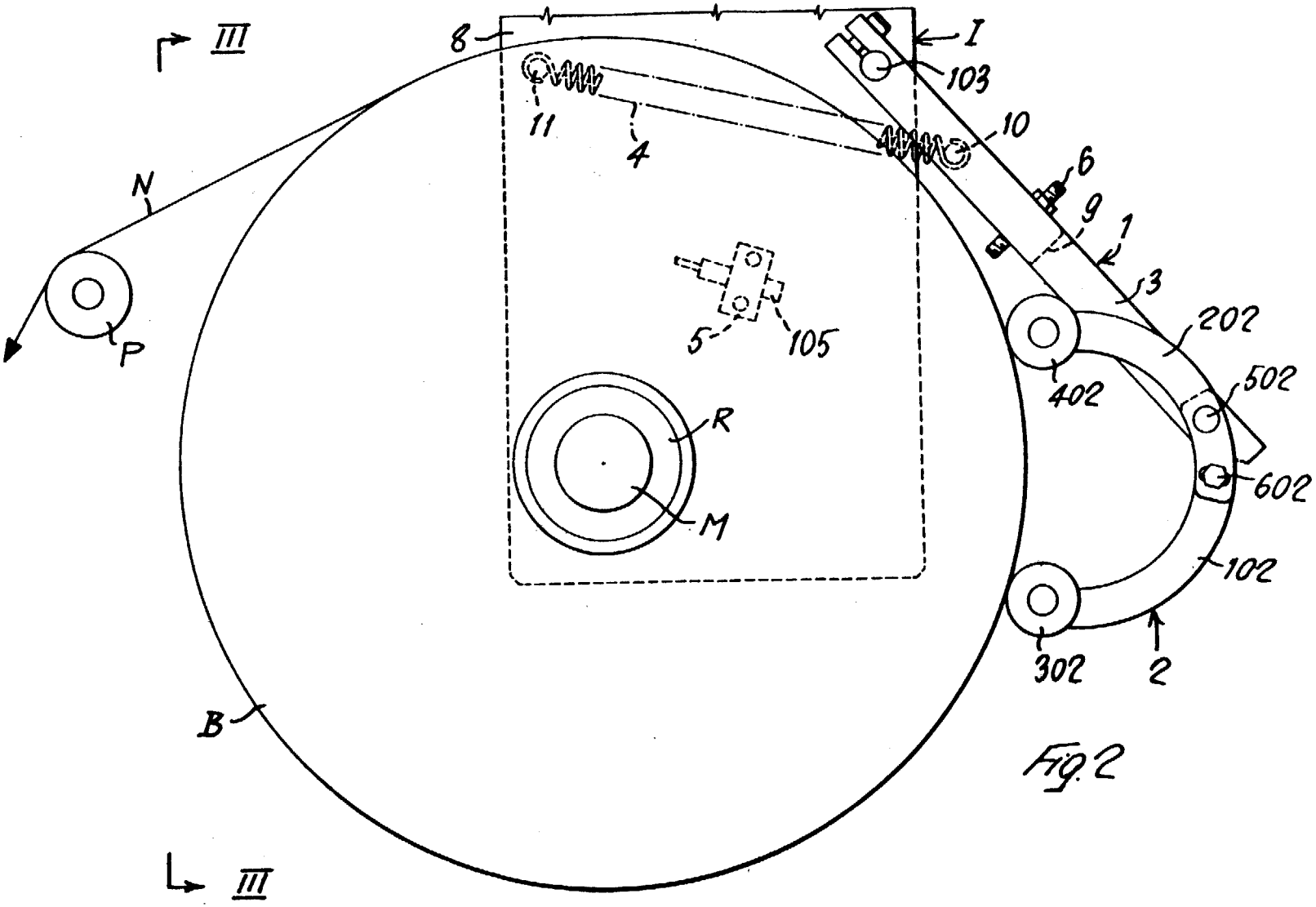
FIG. 2 is a diagrammatic front elevation view similar to FIG. 1, showing the device in its starting phase.
Figure 3:
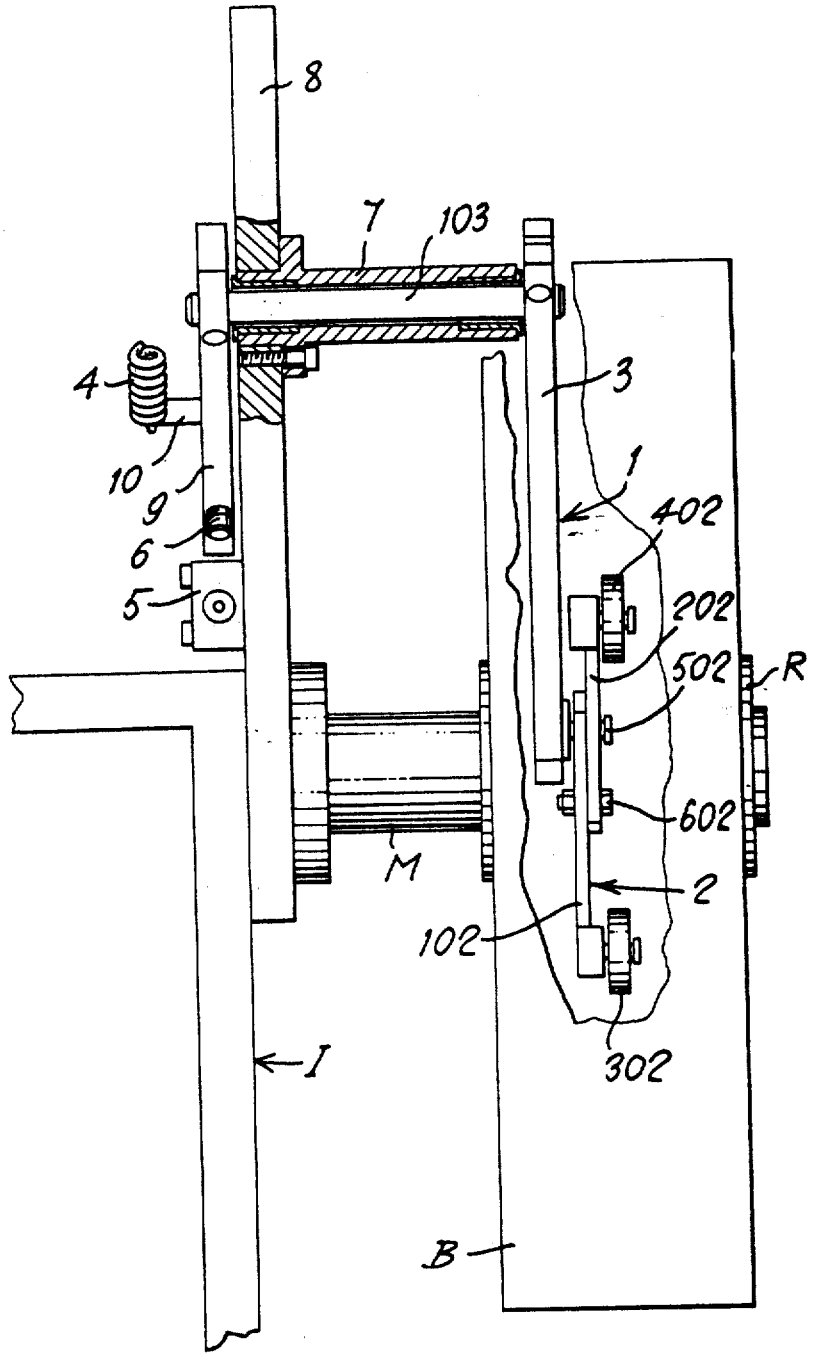
FIG. 3 is a side elevation view of the device, according to line III—III of FIG. 2, with parts broken away.

The sheets of drawings consisting of Figs. 1, 2 and 3 should be added as shown on the attached sheets.

Signed and Sealed this

*First* Day of *January 1985*

[SEAL]

*Attest:*

GERALD J. MOSSINGHOFF

*Attesting Officer*

*Commissioner of Patents and Trademarks*

United States Patent [19]

Cavazza

[11] 4,447,957

[45] May 15, 1984

[54] ROLL DIAMETER SENSING DEVICE

[75] Inventor: Roberto Cavazza, Pianoro, Italy

[73] Assignee: SASIB S.p.A., Bologna, Italy

[21] Appl. No.: 402,340

[22] Filed: Jul. 27, 1982

[30] Foreign Application Priority Data

Jul. 28, 1981 [IT] Italy ..... 12596 A/81

[51] Int. Cl.[3] ..... G01B 5/10

[52] U.S. Cl. ..... 33/172 F; 33/136; 33/178 D

[58] Field of Search ..... 33/172 B, 136, 172 F, 33/178 D, 148 H, 149 J; 200/61.15, 61.16

[56] References Cited

U.S. PATENT DOCUMENTS

| | | | |
|---|---|---|---|
| Re. 30,868 | 2/1982 | Mori | 242/58.1 |
| 1,542,808 | 6/1925 | Adams | 200/61.16 |
| 3,110,110 | 11/1963 | Forrester et al. | 33/149 J |
| 3,201,057 | 8/1965 | Ryan | 242/58.1 |
| 3,285,525 | 11/1966 | Buckler | 242/55.12 |
| 3,519,213 | 7/1970 | Hofmann et al. | 200/61.16 |
| 3,802,085 | 4/1974 | Schoonmaker | 33/172 F |
| 4,215,482 | 8/1980 | Szewczyk | 33/178 D |

*Primary Examiner*—Willis Little

*Attorney, Agent, or Firm*—Spencer & Frank

[57] ABSTRACT

The device for sensing the outer diameter of a roll of web upon unwinding of the web from the roll for the actuation of a control member when the diameter of the roll has been reduced to a predetermined minimum diameter, comprises a follower arm capable of swinging movement to-and-fro in the direction of the axis of the roll around a fixed axis and urged in the direction of the said roll axis. The swinging movement of the follower arm controls the actuation of a control member. The follower arm carries a feeler element intended to bear against the circumferential surface of the web roll, and the said feeler element is constructed as a gauging fork or snap gauge having a pair of arms which are spaced between each other of a predetermined distance, in such a manner that the clear distance or clearance between the said two arms corresponds to the predetermined minimum diameter of the roll.

6 Claims, 3 Drawing Figures

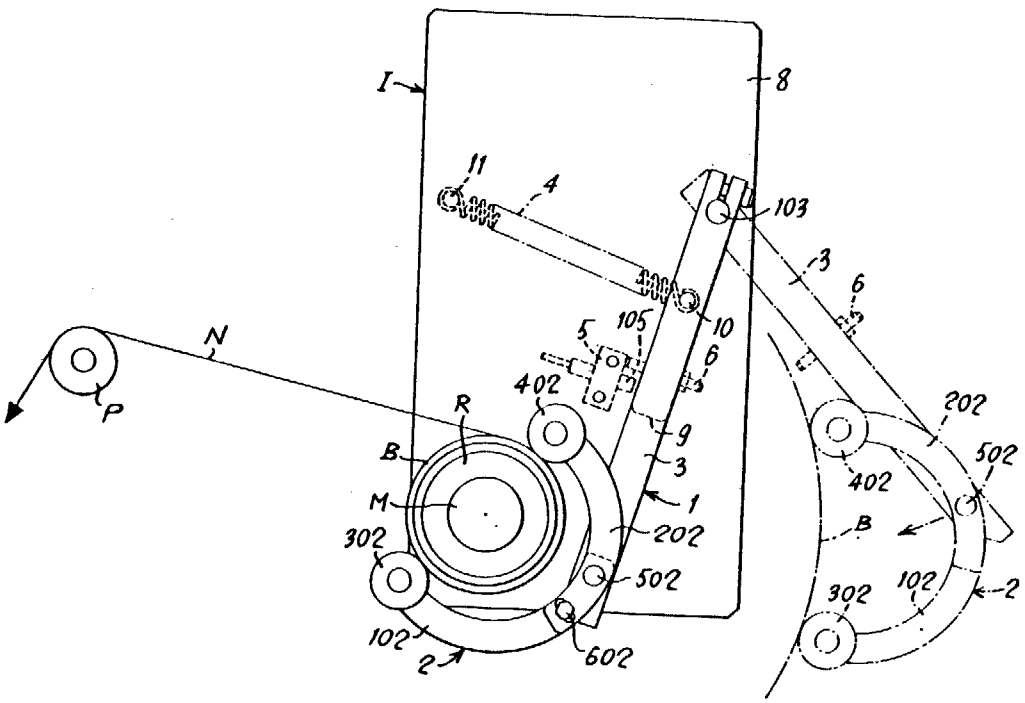

Patent No. 4,447,957 May 15, 1984

Robert Cavazza

Patent No. 4,447,957 May 15, 1984

Robert Cavazza

Robert Cavazza